United States Patent [19]

Sekerich

[11] Patent Number: 4,737,039

[45] Date of Patent: Apr. 12, 1988

[54] DRAWER RAIL CARRIER ROLLER MOUNT

[75] Inventor: Michael E. Sekerich, Saratoga Springs, N.Y.

[73] Assignee: Knape & Vogt Manufacturing Company, Grand Rapids, Mich.

[21] Appl. No.: 939,155

[22] Filed: Dec. 8, 1986

[51] Int. Cl.[4] ..... A47B 88/00; F16C 43/04; A47B 18/04; A63C 17/22

[52] U.S. Cl. ..... 384/18; 301/5.3; 312/337; 312/341 R; 384/19; 384/58; 384/59

[58] Field of Search ..... 384/19–23, 384/58, 47, 48, 50; 54, 59, 296, 416, 417, 478, 439, 449, 548, 539, 585–589, 543, 546, 547; 312/337, 339, 340, 341 R, 341 NR; 301/1, 5.3, 63 PW, 111, 131, 132

[56] References Cited

U.S. PATENT DOCUMENTS

| | | | |
|---|---|---|---|
| 2,505,592 | 4/1950 | Stone | 384/59 |
| 2,525,971 | 10/1950 | Stoe | 384/59 |
| 3,203,749 | 8/1965 | Bullock et al. | 312/339 |
| 3,205,025 | 9/1965 | Jordan . | |
| 3,215,476 | 11/1965 | Jacobs | 384/252 X |
| 3,778,120 | 12/1973 | Hagen et al. | 312/340 X |
| 3,901,564 | 8/1975 | Armstrong | 312/341 X |
| 3,975,063 | 8/1976 | Mahotka et al. | 312/341 R X |
| 4,304,449 | 12/1981 | Litchfield et al. | 312/341 R |
| 4,423,914 | 1/1984 | Vander Ley | 312/333 |

FOREIGN PATENT DOCUMENTS

| | | | |
|---|---|---|---|
| 3346797 | 5/1985 | Fed. Rep. of Germany | 312/341 R |

*Primary Examiner*—Stuart S. Levy
*Assistant Examiner*—Thomas R. Hannon
*Attorney, Agent, or Firm*—Price, Heneveld, Cooper, DeWitt & Litton

[57] ABSTRACT

A drawer rail assembly having a roller mounting and retainer member that connects with a snap fit to the intermediate rail, specifically into a window opening in the intermediate rail, to mount and retain a roller between the upper and lower rails. The retainer has an axle extending from the body thereof, through the roller hub, has slots to receive shoulder flange portions of the intermediate rail cross member, and has hooks to engage one of the offset flanges of the intermediate rail. The interconnection of the slots and shoulder flanges and of the hooks and flange attach the retainer to the rail to support and stabilize the roller. The retainer also covers the roller to shield it, while simultaneously supporting and stabilizing it.

7 Claims, 4 Drawing Sheets

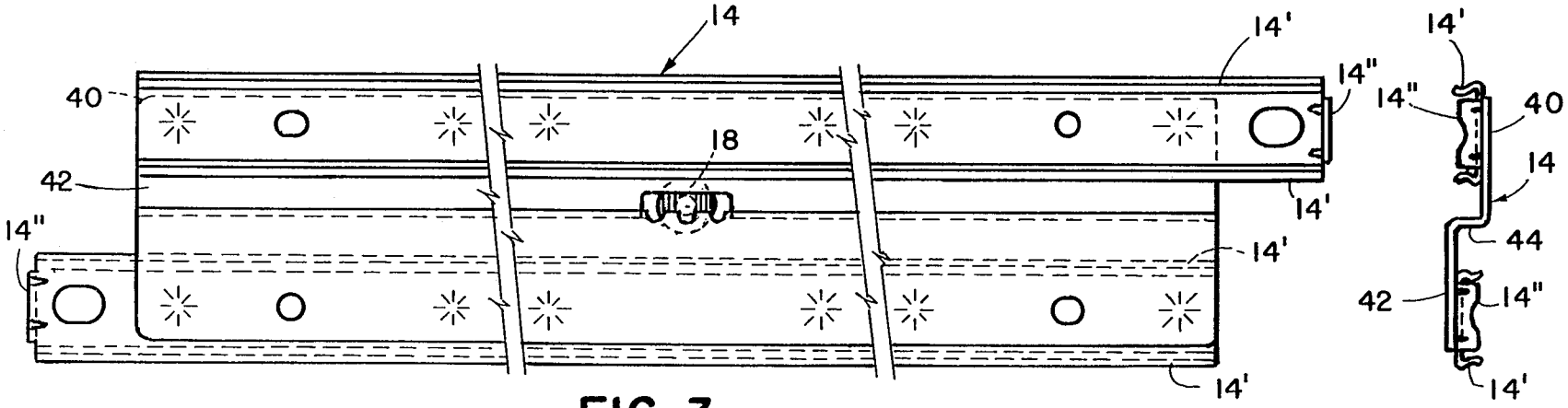
FIG. 3
FIG. 4
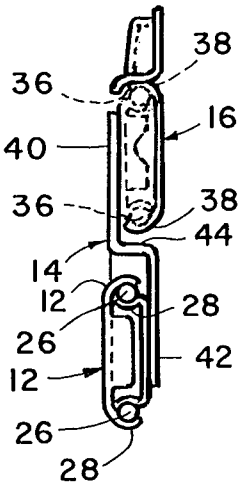
FIG. 2
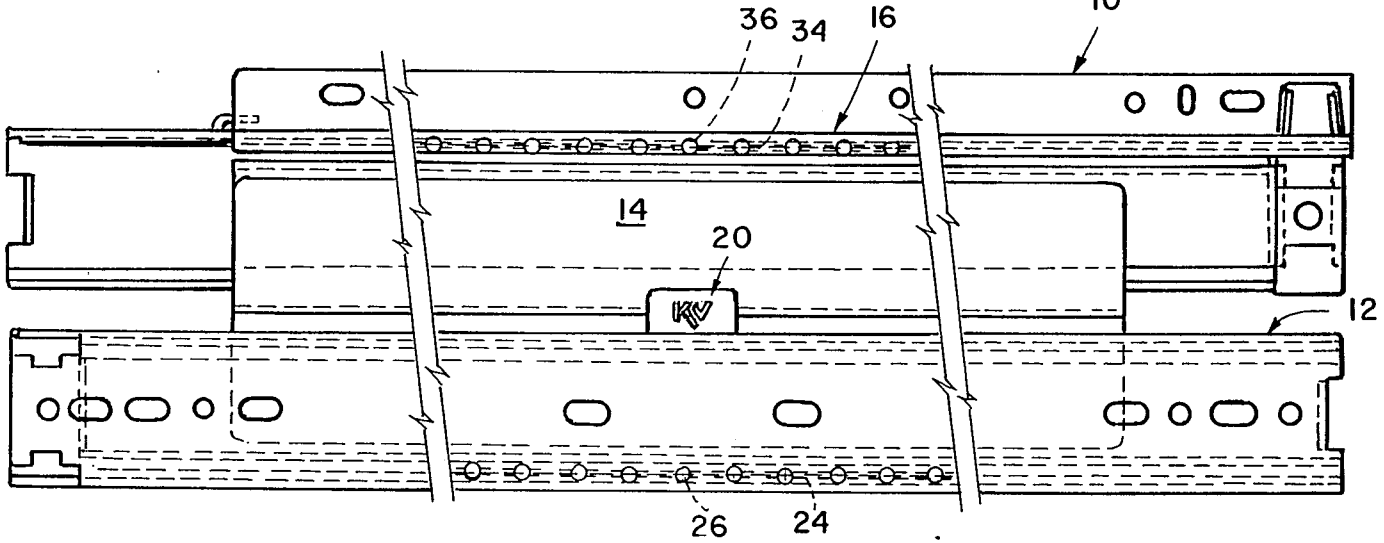
FIG. 1

DRAWER RAIL CARRIER ROLLER MOUNT

BACKGROUND OF THE INVENTION

Drawer rail assemblies often incorporate wheel-shaped rollers. Typically, three rail drawer rail assemblies incorporate a progression roller in the central area thereof to cause progressive movement of the rails. Typical of such arrangements are those shown in U.S. Pat. Nos. 4,423,914 (FIG. 6), 3,203,749 (FIG. 3), and 3,901,564 (FIGS. 1 and 2). That is, a roller is riveted to the intermediate rail or mounted on a pin fixedly attached to the intermediate rail. The upper and lower rails engage the periphery of the roller. Sometimes the upper and lower rails comprise inner and outer rails relative to the intermediate rail. I.e., the intermediate rail has laterally offset flanges connected by a cross member as in U.S. Pat. No. 4,423,914 noted above. In this latter type of unit, the intermediate rail is specially formed with suppor flanges which are orificed to receive the axle pin for mounting the wheel. Therefore not only must the rails be formed as by rolling, but also a series of special stamping, riveting and/or pin affixing operations must be performed to attach the small wheel to the intermediate slide member. These operations cause a permanent assembly to be created. They also add expense and complexity to the fabrication of the rail assembly Such a roller is typically under compression and is therefore slightly deformed. Extensive use of the assembly results in excessive wear of the roller, to the detriment of the entire slide assembly.

SUMMARY OF THE INVENTION

This invention effects a unique mounting of the roller in a drawer rail assembly, enabling simple snap-in attachment of a separable roller retainer, preferably polymeric, with the rail. This snap-in arrangement serves to mount, support and retain the roller, typically a progression roller, in the rail assembly.

Another object of this invention is to provide a roller and roller retainer subassembly that allows roller insertion and retainer attachment by a simple pressure movement on this subassembly relative to the rail. Moreover, the retainer can be readily removed to allow worn roller replacement as necessary or desired. Such replacement is simple and accomplished in mere second. The replacement part is relatively inexpensive and adds new life to the entire assembly.

Another object and feature of the invention is a separable roller mounting and retainer member which interfits with a window opening in the intermediate rail of a rail assembly The retainer member has an axle projecting from the retainer body to interfit with the hub of the roller, and has connecting means for attachment to the rail.

Another object and feature of the invention is a rail assembly with a connectable roller retainer that has slots receiving flange portions of the rail and also resilient hooks that engage another flange portion of the rail, so that the combination connection serves to attach and stabilize the retainer member and hold the roller in position between the upper and lower rails.

The roller retainer member is preferably a polymeric member which has a main body, an axle protruding from the main body, a pair of slotted protrusions to interfit with the flange portions of the rail, and a pair of resilient hooks to engage behind another flange of the rail. These connections cause the retainer to be securely retained in position to hold the roller. The roller and the retainer member can be preassembled with each other and simultaneously inserted into the rail assembly.

Another object of the invention therefore is to provide a rail assembly with a window to receive a connectable retainer preassembled with a progression roller and thereby assembled as a unit to the rail by snap-in connection of the retainer to the rail.

These and several other objects, advantages and features of the invention will become apparent upon studying the following specification in conjunction with the drawings.

BRIEF DESCRIPTION OF THE DRAWINGS

FIG. 1 is a side elevational view of a three rail (right) drawer rail assembly employing this invention, (the left assembly is a mirror image version thereof);

FIG. 2 is an end elevational view of the drawer rail assembly in FIG. 1;

FIG. 3 is an elevational view of the intermediate rail and portions of the upper and lower rails of a left drawer rail assembly in accordance with this invention;

FIG. 4 is an end elevational view of the components in FIGS. 3;

DESCRIPTION OF THE PREFERRED EMBODIMENT

Figure 6:
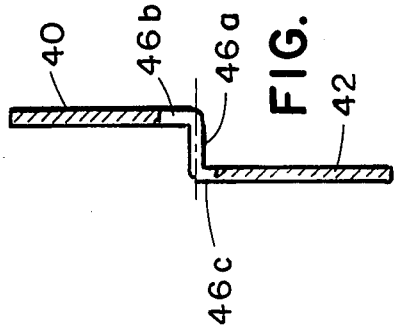
FIG. 6 is a sectional view taken on plane VI—VI of FIG. 5.

Referring now specifically to the drawings, the drawer rail assembly 10 is depicted in FIG. 1 as a three rail drawer rail assembly for the right hand side of the drawer. The three rail drawer rail assembly for the left side of the drawer is the mirror image thereof. This assembly includes an inner rail 12 typically to be mounted to the drawer, an intermediate rail 14, and an outer rail 16 typically to be mounted to the cabinet or other case in which the assembly is to be attached.

The inner rail 12 defines conventional, mutually facing, upper and lower concave elongated tracks 28 for receiving bearing balls 26 retained in spaced relationship with respect to each other by conventional bearing retainers 24 as shown for example in U.S. Pat. No. 3,205,025.

Outer rail 16 likewise defines a pair of upper and lower, mutually facing roller tracks 38 within which a plurality of bearing balls 36 ride in conventional fashion, retained in spaced relationship with each other by conventional bearing retainers 34.

Intermediate rail member 14 comprises a pair of vertically oriented, laterally offset flanges 40 and 42 which are integrally interconnected by a horizontal connecting cross member 44 that extends between upper (inner) rail 12 and the lower (outer) rail 16. Intermediate rail 14 has on these upper and lower vertical flanges 40 and 42 a pair of cooperative bearing retainer and track forming members 14' secured to the flanges 40 and 42 as by welding. These three drawer rails can be moved between a fully extended condition and a fully retracted condition in conventional fashion. Suitable stops, e.g., 14", are provided to limit the movement of the rails with respect to each other in the retracted position. Likewise, conventional internal stops (not visible) laterally project from the rails to engage the bearing retainers for limiting outward extension of the assembly.

In the center of the drawer rail assembly is the novel roller retainer and mounting subassembly 20 (FIG. 1). This subassembly cooperates with a novel opening or window in the intermediate rail. This window extends across horizontal cross member 44 and partially into vertical flanges 40 and 42 adjacent cross member 44.

Figure 7:
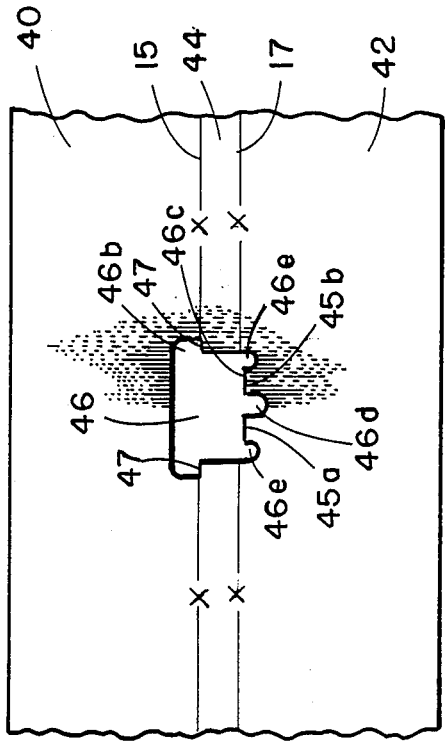
FIG. 7 is a fragmentary elevational view of a stamping showing the central portion of the intermediate rail of FIGS. 5 and 6, prior to bending thereof along longitudinal bend lines to form the offset construction of FIG. 6.
Figure 5:
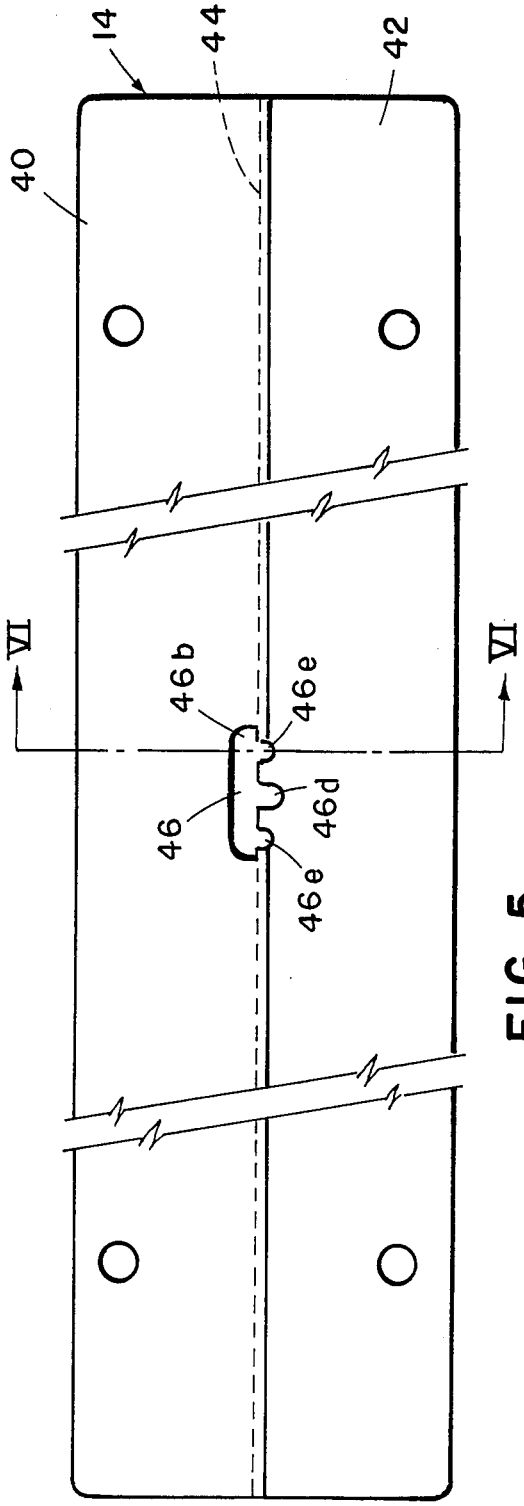
FIG. 5 is an elevational view of the intermediate rail of a drawer rail assembly according to this invention.
Figure 10:
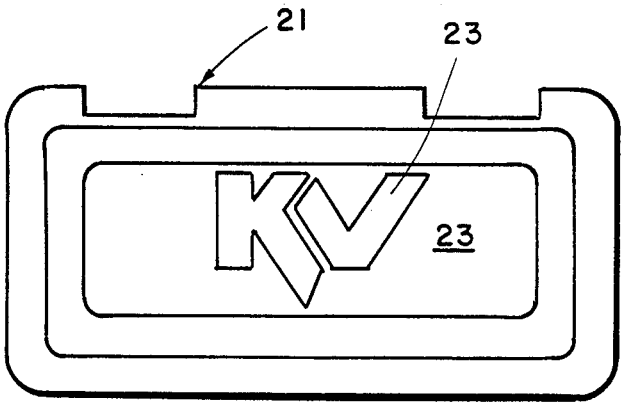
FIG. 10 is an enlarged side elevational view of the roller mounting and retainer member of this invention.
Figure 15:
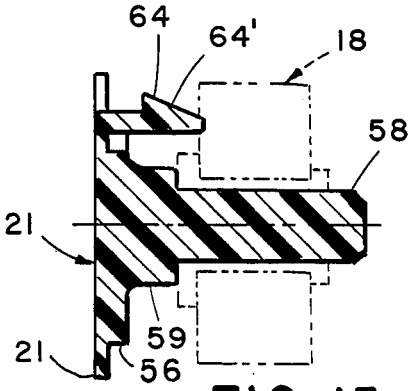
FIG. 15 is a sectional view taken on planes XV—XV of FIG. 12.
Figure 11:
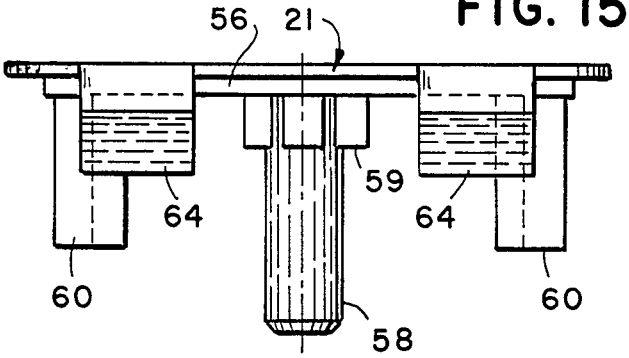
FIG. 11 is a top plan view of the retainer member in FIG. 10.
Figure 13:
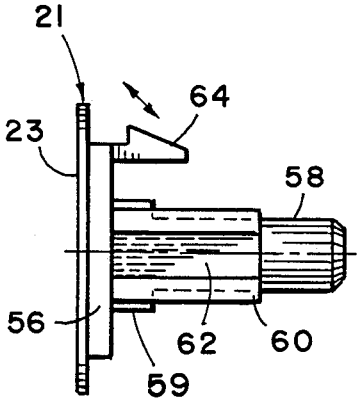
FIG. 13 is an end elevational view of the retainer member in FIG. 12.
Figure 12:
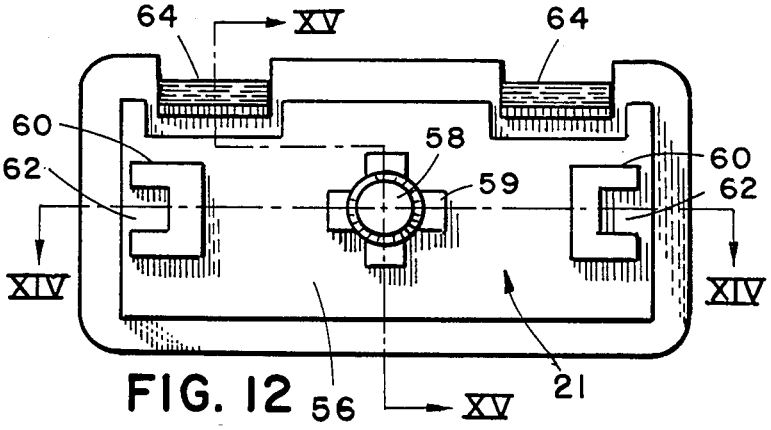
FIG. 12 is a rear elevational view of the retainer member in FIGS. 10 and 11.
Figure 14:
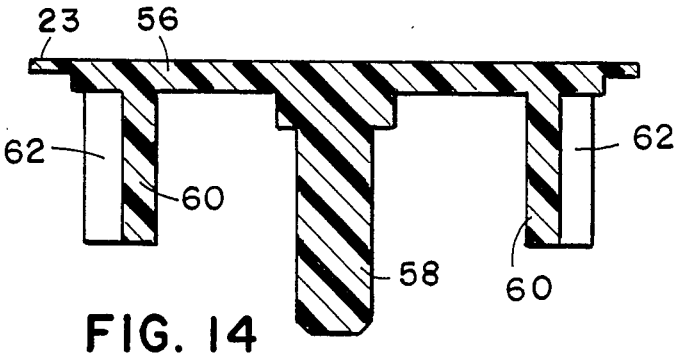
FIG. 14 is a sectional view taken on plane XIV—XIV of FIG. 12.
Figure 8:
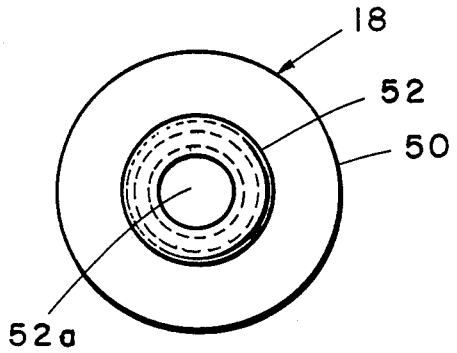
FIG. 8 is an enlarged elevational view of a roller for the assembly.
Figure 9:
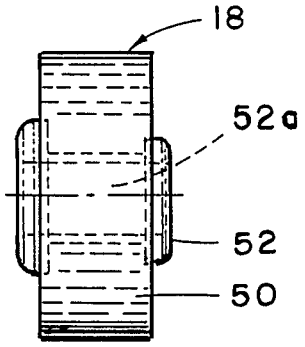
FIG. 9 is an enlarged edge elevational view of the roller in FIG. 8.

In the preferred method of manufacturing the intermediate rail, the window is formed in the planar blank that is subsequently bent along parallel bend lines to form flanges 40 and 42 and cross member 44. More specifically, in FIG. 7 is depicted a central portion of the planar blank of the intermediate rail prior to bending at bend lines 15 and 17 to form the upper and lower flanges and the cross member into a z-shaped shape. The window opening 46 is die cut into this planar member in the configuration depicted in FIG. 7. That is, the portion **46*b* that lies in panel 40 is longer than the remaining portions of opening 46. I.e., the opening is generally T-shaped. The offset between this longer portion 46*b* and the adjacent narrower portion forms a pair of shoulders 47. When this planar member is subsequently formed into the cross sectional configuration depicted in FIG. 6, the main window opening portion 46*a* is located in cross member 44, portion 46*b* extends from portion 46*a* up into upper flange 40 a small distance, and portion 46*c* extends downwardly into vertical flange 42 from portion 46*a* Downwardly extending portion 46*c* also defines an upwardly oriented central concavity 46*d* formed between a pair of upwardly projecting ears 45*a* and 45*b*. Concavity 46*d* serves as an axle receiving recess as will be explained hereinafter. A pair of recesses 46*e* are at the ends of opening 46 in lower flange 42 so that, when the planar blank in FIG. 7 is formed into the offset configuration of FIG. 6, ears 45*a* and 45*b* and recess 46 will protrude vertically upwardly to cause central axle recess 46*d* to remain in a vertical orientation. Shoulders 47 are then oriented laterally (FIG. 16) toward the outer face of panel 40**.

Figure 16:
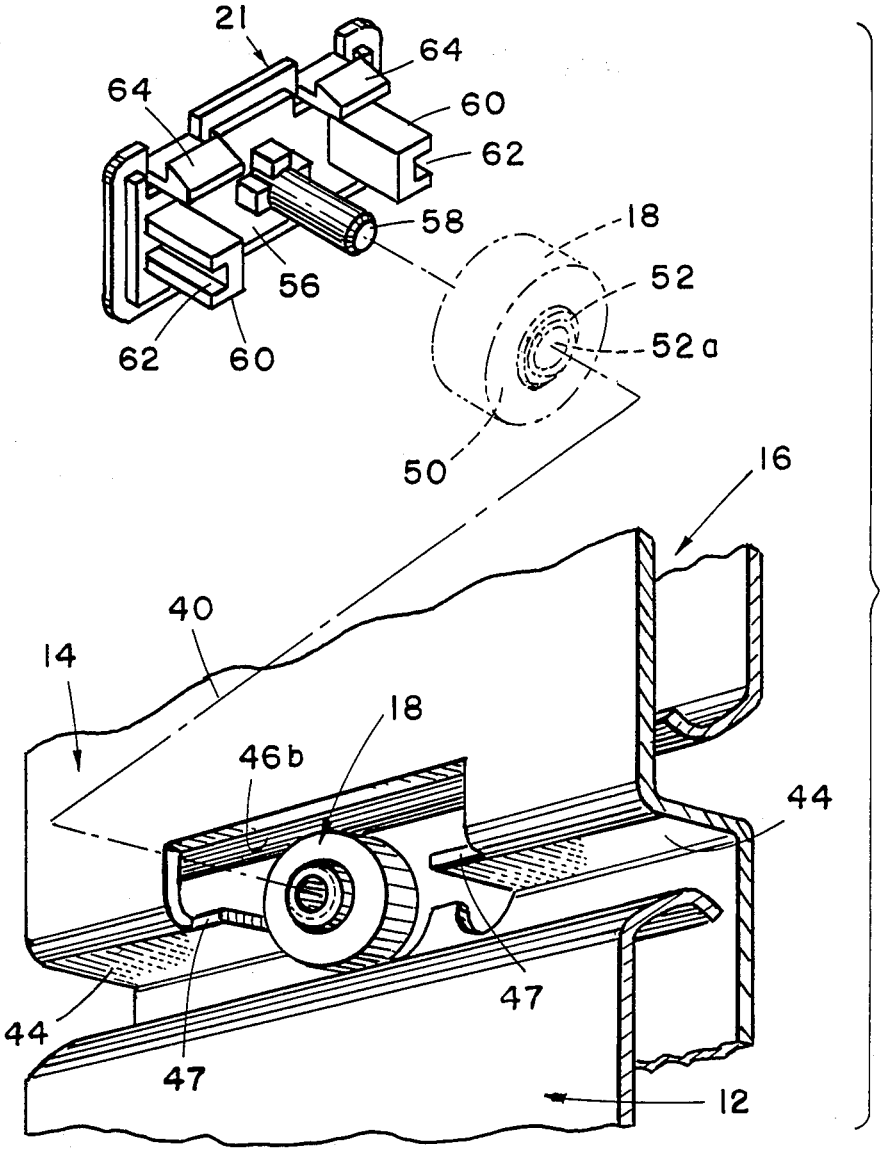
FIG. 16 is a fragmentary, enlarged, exploded view of the mounting and retainer member relative to the rail assembly opening and inserted roller.

To be positioned and mounted in this window opening is a wheel type roller 18 which has a hub 52 and a tire 50 of resilient material such as rubber. The hub defines a cylindrical axle-receiving opening **52*a* therethrough This roller, when in place in the drawer rail assembly, engages the lower surface of upper drawer rail 16 on the upper portion of the tire, and engages the upper surface of lower drawer rail 12 on the lower surface of the tire (FIG. 16**). In this position the tire is somewhat distortionally compressed on the top and bottom, effecting frictional engagement with the rails.

The roller retainer and mounting member 21 of subassembly 20 is depicted in detail in FIGS. 10–16. It preferably includes a planar body 56 having an integral cantilever axle 58 extending laterally therefrom, i.e., transverse to the planar body, to interfit with the opening **52*a* in hub 52 of roller 18. Astraddle axle 58 is a pair of integral protrusions 60 also transverse to the planar body, each protrusion having a horizontal slot 62. Slots 62 face in opposite directions to each other, i.e., outwardly toward the ends of the retainer as well as being open on the outer end. Around the base of cantilevered axle 58 is an annular stop means 59 to limit the insertion of the axle relative to the roller. At the top of body 56, on opposite sides of the central axle 58, is a pair of integral resilient hooks 64 resiliently deformable downwardly about their integral juncture with body 56 to allow the outer end thereof to deflect and engage behind flange 40 of the intermediate rail in a manner to be described. The front of member 21 can include a decorative faceplate 23 for applying the trademark 25** of the manufacturer, or other indicia.

The oppositely facing slots 62 are to receive the shoulder edges 47 of the intermediate rail, thereby vertically fixing the relationship of the retainer relative to the rail assembly and window opening as member 21 is pressed into the window. Further insertion of member 21 causes hooks 60 to deflect and engage behind the flange 40 at the upper edge of window 46 in the intermediate rail.

Assembly of the roller and retainer into the drawer rail assembly can be achieved in one of two ways. In one way, the roller and retainer are preassembled with respect to each other and then inserted. This is done by placing the roller over axle 58 until the inner end of the roller abuts stops 59. (See FIG. 15 wherein roller 18 is depicted in phantom on member 21.) Then this subassembly is inserted into the window by pressing, e.g., finger pressure, slightly deforming the upper and lower edges of resilient tire 50 of the roller with engagement of the upper and lower rails. By pressing this subassembly into the window, slots 62 align with and receive the shoulder flanges 47 of cross member 44 at the ends of window 46, and then hooks 60 are deflected downwardly by engagement of the sloped ramp front surfaces 64' (FIG. 15) thereof with the upper edge of window portion **46*b* until the hooks snap behind this upper edge to secure the assembly. At this point, the inner cantilevered end of axle 58 rests within cavity 46*d* so that the axle is supported on both of its ends. This assembly then remains in position until it is desired to remove the roller, at which time the lower edge of retainer 21 is pried outwardly away from the rail assembly as with a screwdriver, a finger, or the like, to release hooks 60** from the flange and disassemble the retainer and roller.

As an alternative to assembling the roller and retainer as a subassembly to the drawer rail apparatus, roller 18 can be first inserted into position as depicted in FIG. 16, i.e., with its upper and lower portions engaging the inner and outer rails, and its hub in alignment with recess **46*d* of window 46, and then inserting retainer 21** by extending axle 58 through hub opening 52*a*, causing slots 62 to align with and engage shoulder flanges 47 and then resilient hooks 60 deflected downwardly by the lower edge of flange 40 at the top edge of window portion 46*b* to snap into place behind it.

When the assembly is complete, the roller is securely retained. Moreover, it is protected on its outer face. The retainer further renders the assembly more attractive in appearance.

If, after extended use, roller 18 becomes disabled or deformed because of the significant deflection pressures constantly applied to it in its usual function, this roller can be quickly replaced by simply snapping the retainer and mounting member out, replacing the roller, and snapping it back into position. Even if the entire retainer is substituted or replaced along with the roller, the cost is relatively insignificant and the time involved is mere seconds. Consequently, the useful life of an expensive drawer rail assembly can be extended repeatedly by quick, easy, inexpensive replacement of the roller member which performs a key function but has a relatively short life compared to the other components of the assembly.

Conceivably, certain minor variations in the construction set forth as the preferred embodiment could be made without departing from the inventive concept taught. Hence, the invention is not intended to be limited by the illustrative embodiment depicted, but only by the scope of the appended claims and the reasonably equivalent structures to those defined therein.

The embodiments of the invention in which an exclusive property or privilege is claimed are defined as follows:

1. In a drawer rail assembly having an upper rail, a lower rail and an intermediate rail, said intermediate rail having a pair of laterally offset flanges and a connecting member therebetween, said upper rail being above said connecting member and said lower rail being below said connecting member;

an opening in said connecting member to receive a roller engageable with both said upper rail and said lower rail;

a roller in said opening;

an attachable roller mounting and retainer member for mounting and retaining said roller in said opening between said upper and lower rails;

said roller mounting and retainer member having releasable connection means for removable attachment to said intermediate rail whereby said roller mounting and retainer member can be released for replacement of said roller;

said connection means including slot means for receiving portions of said intermediate rails, and hook means for engaging other portions of said intermediate rail;

said intermediate rail having, adjacent said opening, a pair of shoulder flanges on said connecting member to be received by said slot means when said roller mounting and retaining member is attached to said intermediate rail, and having a flange portion on one of said offset flanges of said intermediate rail to engage said hook means.

2. In a drawer rail assembly having an upper rail, a lower rail and an intermediate rail, said intermediate rail having a pair of vertical, laterally offset flanges and a horizontal connecting member therebetween in a Z-shaped configuration, said upper rail being above said connecting member and said lower rail being below said connecting member;

an opening in said connecting member to receive a vertical roller engageable with both said upper rail and said lower rail;

a vertical roller in said opening;

an attachable roller mounting and retainer member for mounting and retaining said roller in said opening between said upper and lower rails;

said roller mounting and retainer member having releasable connection means for removable attachment to said intermediate rail whereby said roller mounting and retainer member can be released for replacement of said roller;

said roller mounting and retainer member having a body and a projecting axle on said body;

said roller having a hub;

said axle being fitted within said hub when said retainer member is attached to said intermediate rail;

said projecting axle having a free end, and said intermediate rail including an axle receiving recess in the offset flange opposite said roller mounting and retainer member, to receive said free end of said axle whereby both ends of said axle are supported when said member and roller are assembled to said intermediate rail.

3. In a drawer rail assembly having an upper rail, a lower rail and an intermediate rail, said intermediate rail having a pair of laterally offset flanges and a connecting member therebetween, said upper rail being above said connecting member and said lower rail being below said connecting member;

an opening in said connecting member to receive a roller engageable with both said upper rail and said lower rail;

a roller in said opening;

an attachable roller mounting and retainer member for mounting and retaining said roller in said opening between said upper and lower rails;

said roller mounting and retainer member having releasable connection means for removable attachment to said intermediate rail whereby said roller mounting and retainer member can be released for replacement of said roller;

said roller mounting and retainer member having a body and a projecting axle on said body;

said roller having a hub;

said axle being fitted within said hub when said retainer member is attached to said intermediate rail;

said roller mounting and retainer member being polymeric, having a generally planar body, said axle projecting normal to said body, and said body having projecting therefrom a pair of protrusions spaced from each other generally astraddle of said axle, having outer ends, and having slots.

4. The drawer rail assembly in claim 3 wherein said slots extend in opposite outward directions to each other and are open on said outer ends of said protrusions.

5. A drawer rail, roller, and roller mounting and retaining member assembly, said drawer rail having a pair of offset vertical flanges and a horizontal connecting cross member in a Z-shaped configuration, an opening with peripheral edges in said cross member, said roller being positioned in said opening and having a hub, said roller mounting and retainer member having a body and an axle extending therefrom into said hub, and connection means attached to said rail at said peripheral edges for connecting said body to said rail;

said opening including a portion extending into at least one of said flanges, and said connection means including resilient means for connecting said body at said peripheral edges;

said body covering said opening portion;

said member having protruding connecting portions engaging said rail for vertically retaining said member and said roller, and having resilient fastening means oriented to engage behind vertical portions of said rail for fixing said member to said rail;

said peripheral edges including horizontal shoulders and said protruding connecting portions interengaging with said shoulders;

said resilient fastening means comprising hooks engageable behind the vertical portions of said peripheral edges; and said axle having a free end and said rail having a recess receiving said free end whereby both ends of said axle are supported.

6. A drawer rail, roller, and roller mounting and retaining member assembly, said drawer rail having a pair of offset vertical flanges and a horizontal connecting cross member in a Z-shaped configuration, an opening with peripheral edges in said cross member; said roller being positioned in said opening and having a hub; said roller mounting and retaining member having a body and an axle extending therefrom into said hub, and connection means attached to said rail at said peripheral edges for connecting said body to said rail;

said opening including a portion extending into at least one of said flanges, and said connection means including resilient means for connecting said body at said peripheral edges;

said member having a pair of protrusions with slots and said opening edges including a pair of shoulder flanges received by said slots.

7. A roller mounting and retainer member for attaching a roller to a drawer rail, comprising:

a body, an axle protruding from said body for mounting a roller thereon, horizontal protruding connecting portions on said body for vertically retaining said member and a roller thereon with respect to a rail, and resilient fastening portions for retaining said member with respect to a rail;

said protruding connecting portions being slotted horizontally to engage with horizontal flanges of the rail, and said resilient fastening portions being hooked and oriented to engage a vertical flange of the rail.

* * * * *

UNITED STATES PATENT AND TRADEMARK OFFICE

CERTIFICATE OF CORRECTION

PATENT NO. : 4,737,039

DATED : April 12, 1988

INVENTOR(S) : Michael E. Sekerich

It is certified that error appears in the above-identified patent and that said Letters Patent is hereby corrected as shown below:

Column 1, line 20;
"suppor" should be -- support --;

Column 1, line 46;
"second." should be -- seconds. --;

Column 2, line 24;
"Figs. 3" should be -- Fig. 3 --;

Column 5, Claim 1, Line 54;
"rails" should be -- rail --.

Signed and Sealed this

Twenty-second Day of November, 1988

*Attest:*

DONALD J. QUIGG

*Attesting Officer*

*Commissioner of Patents and Trademarks*